US009259921B2

(12) United States Patent
Shirakawa et al.

(10) Patent No.: US 9,259,921 B2
(45) Date of Patent: Feb. 16, 2016

(54) INK JET PRINTING APPARATUS, INK JET PRINTING METHOD, AND NON-TRANSITORY COMPUTER-READABLE STORAGE MEDIUM

(71) Applicant: CANON KABUSHIKI KAISHA, Tokyo (JP)

(72) Inventors: Hiroaki Shirakawa, Kawasaki (JP); Yosuke Ishii, Kawasaki (JP); Taku Yokozawa, Yokohama (JP); Mitsutoshi Nagamura, Tokyo (JP); Yuhei Oikawa, Yokohama (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/739,473

(22) Filed: Jun. 15, 2015

(65) Prior Publication Data

US 2015/0367632 A1 Dec. 24, 2015

(30) Foreign Application Priority Data

Jun. 18, 2014 (JP) ..... 2014-125610

(51) Int. Cl.
*B41J 29/38* (2006.01)
*B41J 2/045* (2006.01)

(52) U.S. Cl.
CPC ..... *B41J 2/04563* (2013.01); *B41J 2/04585* (2013.01)

(58) Field of Classification Search
CPC ..... B41J 2/14056; B41J 2/04528; B41J 2/04563; B41J 2/04565; B41J 2/04568; B41J 2/04585
USPC ..... 347/5, 9, 10, 11, 12, 13, 14, 17, 54, 56
See application file for complete search history.

(56) References Cited

U.S. PATENT DOCUMENTS 6,378,994 B1 * 4/2002 Ueda ..... B41J 2/14024 347/65
6,634,731 B2 * 10/2003 Kao ..... B41J 2/04515 347/14
8,033,631 B2 * 10/2011 Kanno ..... B41J 2/04541 347/17
8,517,498 B2 * 8/2013 Makita ..... B41J 2/04516 347/17
8,833,889 B2 * 9/2014 Kanno ..... B41J 2/04508 347/9

FOREIGN PATENT DOCUMENTS

JP 4-22727 A 1/1992
JP 4-250057 A 9/1992

* cited by examiner

*Primary Examiner* — Anh T. N. Vo
(74) *Attorney, Agent, or Firm* — Canon USA Inc. IP Division

(57) ABSTRACT

First heating is started at a first time point, and a second heating having higher heating energy than the first heating is started at a second time point subsequent to the first time point.

14 Claims, 16 Drawing Sheets

FIG. 11

| X [s] | TEMPERATURE RANGE [°C ] |
|---|---|
| 0 | 30.0 TO 40.0 |
| 1 | 24.0 TO 29.9 |
| 2 | 22.0 TO 23.9 |
| 3 | 20.5 TO 21.9 |
| 4 | 19.0 TO 20.4 |
| 5 | 18.0 TO 18.9 |
| 6 | 17.0 TO 17.9 |
| 7 | 16.0 TO 16.9 |
| 8 | 15.5 TO 15.9 |
| 9 | 15.2 TO 15.4 |
| 10 | 15.1 OR BELOW |

FIG. 13

| Tx [°C ] | TEMPERATURE RANGE [°C ] |
|---|---|
| 7.0 | 30.0 TO 40.0 |
| 7.5 | 24.0 TO 29.9 |
| 8.0 | 22.0 TO 23.9 |
| 8.5 | 20.5 TO 21.9 |
| 9.0 | 19.0 TO 20.4 |
| 10 | 18.0 TO 18.9 |
| 11 | 17.0 TO 17.9 |
| 12 | 16.0 TO 16.9 |
| 13 | 15.5 TO 15.9 |
| 14 | 15.2 TO 15.4 |
| 15 | 15.1 OR BELOW |

INK JET PRINTING APPARATUS, INK JET PRINTING METHOD, AND NON-TRANSITORY COMPUTER-READABLE STORAGE MEDIUM

BACKGROUND OF THE INVENTION

1. Field of the Invention

The present invention relates to an ink jet printing apparatus, an ink jet printing method, and a non-transitory computer-readable storage medium.

2. Description of the Related Art

Known ink jet printing apparatuses include an ink jet printing apparatus that uses a printing head having a substrate on which a printing element array having a plurality of printing elements that generate thermal energy used to eject ink are arranged in an array direction. In this apparatus, the printing elements are driven while the printing head is moved in such a manner as to scan a printing medium, whereby thermal energy is given to ink near the printing elements and ink is ejected onto the printing medium to form an image.

In such an ink jet printing apparatus, it is known that there is a case in which ejection volume is decreased or ejection fails when the temperature of ink at the time of ejecting the ink is low. When such a phenomenon is generated, the quality of a printed image is degraded. To cope with this problem, Japanese Patent Laid-Open No. 4-22727 discloses a technology in which by providing a temperature adjustment heater (hereinafter, also called a sub-heater or a heating element) for heating ink in the vicinity of printing elements on a substrate, ink is heated through short-pulse heating control, in which heating is performed by providing the printing elements with driving pulses short enough not to allow ink to be ejected, together with sub-heater control using the sub-heater. It is stated in the above document that heating to a target temperature is performed through control of short-pulse heating, which has a relatively high heating capability, and the temperature is then maintained through control of sub-heater heating having a relatively low heating capability.

On the other hand, there may be a case where a temperature distribution in which temperature changes in accordance with the positions of the printing elements in the array direction is generated, even when uniform thermal energy is applied to ink in the vicinity of the printing elements within the printing element array. The higher the temperature, the higher the ejection volume and, hence, the ejection volume varies among the printing elements in accordance with this temperature distribution. This may result in generation of uneven color density in a printed image. Regarding this problem, it is stated in Japanese Patent Laid-Open No. 4-250057 that the above-described temperature distribution is reduced by providing a plurality of sub-heaters and temperature sensors in the substrate in accordance with the positions in the array direction and by driving the sub-heaters partially on the basis of the temperatures detected by the temperature sensors.

However, it turned out that a decrease in image quality due to variations in the ejection volume may not be sufficiently suppressed even when the method disclosed in Japanese Patent Laid-Open No. 4-22727 is employed, if a temperature distribution in which temperature changes in accordance with the positions of the printing elements in the array direction is generated when uniform thermal energy is applied to the printing element array. In addition, it turned out that the durability of a printing head may decrease.

Hereinafter, this problem will be described in detail.

Note that the case described below is a case in which the temperature of the end portions of the printing element array in the array direction is more likely than that of the center portion to be decreased due to heat dissipation.

FIGS. 1A and 1B are diagrams for respectively illustrating changes in temperature at the end portions and center portion of the printing element array, and a temperature distribution, in the case where heating to a target temperature is performed only through control of short-pulse heating which has a relatively high heating capability. Note that the target temperature is 40° C. in the case described here. The temperature in the apparatus near the printing head within the inkjet printing apparatus is 25° C.

FIG. 1A is a diagram illustrating changes in temperature at the end portions and center portion of the printing element array in the array direction in the case where heating to a target temperature is performed only through short-pulse heating. Note that, in FIG. 1A, the solid line represents a change in temperature at the center portion of the printing element array and the broken line represents a change in temperature at the end portions of the printing element array. Since the temperature of ink is approximately the same as that of the substrate, the substrate temperature is obtained and used as the temperature of ink.

As described above, when the printing elements in the printing element array are uniformly heated, the substrate temperature at the center of the printing element array is likely to increase more than the substrate temperature at the end portion, due to heat dissipation at the end portions of the printing element array. Hence, at the center portion, the target temperature of 40° C. is reached at a time point when elapsed time $T=t1$ ($0<t1<0.5$) seconds, after short-pulse heating was started. At this time point, the substrate temperature at the end portions is about 32° C.

At a time point when the elapsed time $T=t2$ ($1.5<t2<2$) seconds, while short-pulse heating has been continued, the temperature at the end portions reaches 40° C., which is a target temperature. At this time point, the temperature at the center portion of the substrate has reached 60° C., because heating has been continued for additional ($t2-t1$) seconds after the target temperature was reached.

FIG. 1B is a diagram illustrating the substrate temperature distribution within the printing element array after the short-pulse heating has been performed. Note that, in FIG. 1B, the solid line represents the temperature distribution observed t2 seconds after the short-pulse heating was started, and the broken line represents the temperature distribution observed t1 seconds after the short-pulse heating was started.

At a time point when the elapsed time $T=t1$ seconds, at which the substrate temperature at the center of the printing element array reaches the target temperature, the substrate temperature at the end portions is lower than the target temperature, as described above. Hence, in the case in which ink ejection is performed at a time point when the elapsed time $T=t1$ seconds, the ejection volume may be decreased or ejection may not be performed in the printing elements at the end portions, since the substrate temperature at the end portions has not reached the target temperature.

On the other hand, at a time point when the elapsed time $T=t2$, at which the substrate temperature of the end portions of the printing element array reaches the target temperature, the substrate temperature at the center portion considerably exceeds the target temperature. Note that such a phenomenon, in which the target temperature is considerably exceeded during heating, is also called an overshoot phenomenon. As a result, when ink is ejected, there may be a case in which the volume of ink ejected from printing elements at the center portion is increased. Further, in the case in which the ejection port member provided in such a manner as to face the printing elements is formed of a resin or the like, the ejection port member may gradually be deformed due to a thermal stress produced by this overshoot phenomenon. This deformation of the ejection port member may cause a decrease in the durability of the printing head.

The above-described variations in the ejection volume and the decrease in the durability of the printing head may occur also in the case where short-pulse heating and sub-heater heating are used together.

FIG. 2A is a diagram illustrating changes in temperature respectively at the end portions and center portion of the printing element array in the array direction in the case where short-pulse heating and sub-heater heating are started at the same time. FIG. 2B is a diagram illustrating the temperature distributions of the substrate at a time point when the elapsed time T=t1 at which the center portion has reached a target temperature and at a time point when the elapsed time T=t2 at which the end portion has reached a target temperature, after the start of heating, illustrated in FIG. 2A.

As can be seen from FIG. 2B, also in the case where the short-pulse heating and sub-heater heating are started at the same time, a non-uniform temperature distribution may be generated to some extent in some cases. Hence, a decrease in durability due to variations in the ejection volume or an overshoot phenomenon may be generated.

SUMMARY OF THE INVENTION

In view of the above-described problems, the present invention provides printing in which variations in ejection volume and a decrease in the durability of a printing head caused by a non-uniform temperature distribution within a printing element array are suppressed.

An example of the present invention is an inkjet printing apparatus including: a printing head including a substrate including at least a printing element array in which a plurality of printing elements for generating thermal energy used to eject ink from ejection ports are arranged in a predetermined direction and at least a heating element for heating ink near the printing elements, the heating element being provided near at least one end portion of the printing element array in the predetermined direction; a heating control unit that causes execution of first heating that heats ink near the printing elements by causing the heating element to generate a first amount of thermal energy per unit time by driving the heating element and execution of second heating that heats ink near the printing elements by causing the printing elements to generate a second amount of thermal energy per unit time larger than the first amount by driving the printing elements; and a printing control unit that performs control in such a manner that ink ejection from the printing head is started when a temperature of ink near the printing elements reaches a predetermined temperature as a result of the first and second heating caused by the heating control unit. The heating control unit starts driving the heating element using the first heating unit at a first time point and starts driving the printing elements using the second heating unit at a second time point subsequent to the first time point.

Further features of the present invention will become apparent from the following description of exemplary embodiments with reference to the attached drawings.

BRIEF DESCRIPTION OF THE DRAWINGS

FIG. 11 is a table illustrating a relationship between a temperature and a threshold time in an embodiment.

FIG. 13 is a table illustrating a relationship between a temperature and a threshold temperature rise amount in an embodiment.

DESCRIPTION OF THE EMBODIMENTS

Hereinafter, a first embodiment of the present invention will be described in detail with reference to the drawings.

First Embodiment

Figure 3:
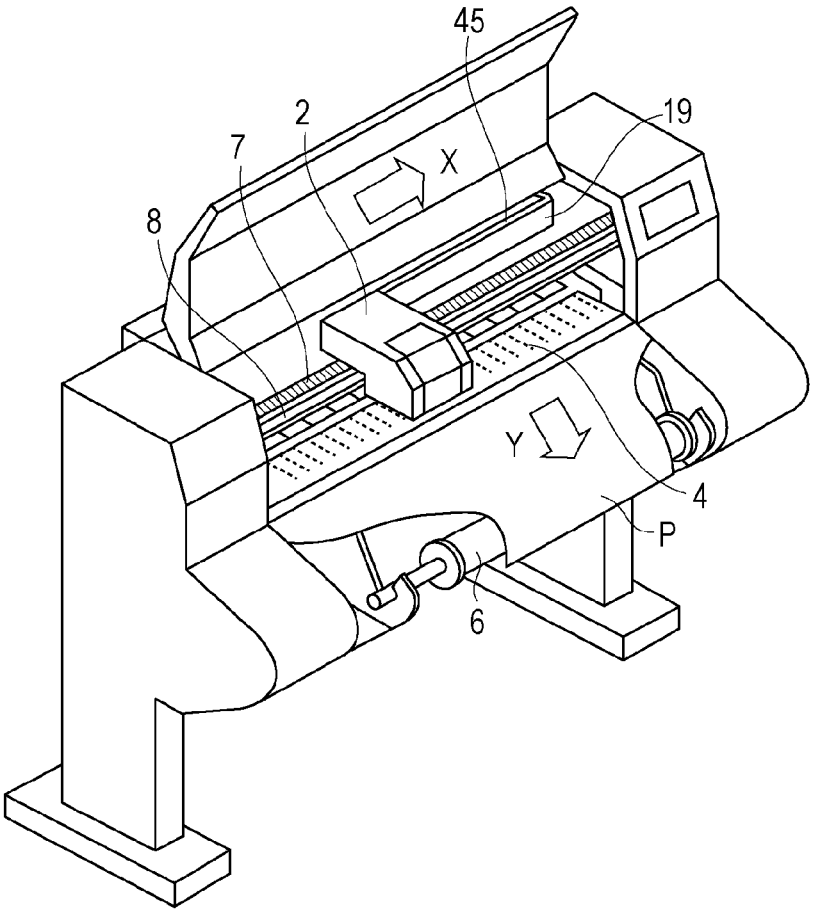
FIG. 3 is a perspective view of an inkjet printing apparatus according to an embodiment.

FIG. 3 illustrates an external view of an inkjet printing apparatus (hereinafter, also called a printer). This is a serial scan printer, which prints an image by making a printing head performing scanning in a scanning direction (X direction) which crosses a conveying direction (Y direction) in which a printing medium P is conveyed.

The configuration and printing operation of the inkjet printing apparatus will be briefly described with reference to FIG. 3. First, the printing medium P is conveyed in the Y direction from a spool 6 holding the printing medium P by a conveying roller which is driven by a conveying motor (not illustrated) via a gear. At a predetermined conveying position, a carriage unit 2 is made to perform scanning along a guide shaft 8 extending in the X direction, using a carriage motor (not illustrated). During this scanning process, an operation of ejection from ejection ports of a printing head (described later), which is detachably mounted on the carriage unit 2, is performed with timing based on a position signal obtained by an encoder 7, thereby printing a predetermined band width corresponding to the nozzle array region. In the present embodiment, a configuration is employed in which scanning is performed at a scanning speed of 40 inches per second, and the ejection operation is performed at a timing corresponding to that of 600 dpi. Then, the printing medium is conveyed and printing for the next band width is performed.

With a printer like this, an image may be printed in a unit area on a printing medium through a single scanning operation (one-pass printing), or an image may be printed through a plurality of scanning operations (multi-pass printing). When one-pass printing is performed, the printing medium may be conveyed in a unit of approximately a band width between scanning operations. When multi-pass printing is performed, the printing medium may be conveyed in a unit of approximately a single band on the printing medium after performing scanning multiple times for the unit area, without conveying the printing medium for every single scanning operation. As an alternative multi-path printing method, there is a method in which after printing data, which has been thinned by a predetermined mask pattern, in every scanning operation, paper is fed in approximately 1/n bands, and a scanning operation is performed again, whereby an image is completed by a plurality (n) of scanning operations using different nozzles participating in printing for a unit area on the printing medium.

One end of a flexible wiring substrate (not illustrated) for providing signal pulses for ejection driving, a head temperature adjusting signal, and the like is connected to the printing head. The other end of the flexible substrate is connected to a control circuit (described later) that includes a control circuit for performing control of the printer.

The printer includes an apparatus-internal-temperature sensor (not illustrated) for detecting an apparatus internal temperature near the printing head.

Note that a carriage belt can be used to convey a driving force from the carriage motor to the carriage unit 2. However, instead of the carriage belt, another driving system may be used, such as one including a lead screw that is driven by the carriage motor through a rotational driving force and extends in the X direction and an engaging portion provided in the carriage unit 2 engaged with the slit of the lead screw.

The fed printing medium P is guided to a printing position (main scan region of the printing head) on a platen 4, while being sandwiched between and conveyed by a sheet feeing roller and a pinch roller. Since the face of the printing head is usually being capped in an inactive state, the printing head or the carriage unit 2 is made to enter a scan-enabled state by releasing the cap before printing. After that, when data for a single scan is stored in a buffer, the carriage motor is used to make the carriage unit 2 perform scanning, whereby printing is performed as described above.

Figure 4:
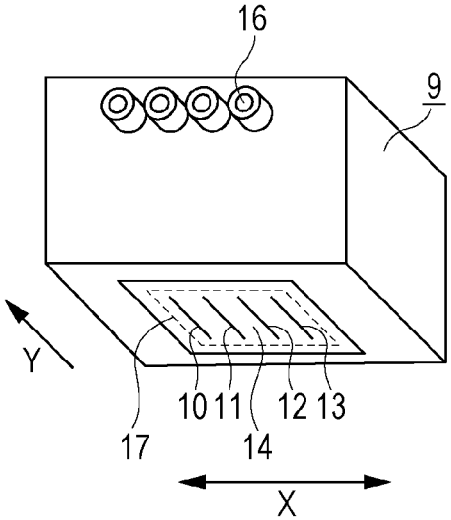
FIG. 4 is a perspective view of a printing head according to an embodiment.

FIG. 4 is a schematic perspective view of a printing head 9 according to the present embodiment viewed from a direction in which ink is ejected.

The printing head 9 has a joint portion 16 formed thereon, and the joint portion 16 is connected to an ink supply path extending from an ink tank (not illustrated) arranged at a position spaced apart from the printing head 9. Ink is supplied from the ink tank to the inside of the printing head 9 through the ink supply path and the joint portion 16. A substrate 14 made of a semiconductor or the like is attached to an ejection port formation face, which is a face of the printing head 9 facing the printing medium P. Ejection port arrays are formed on the substrate 14 along a direction perpendicular to the X direction. In the present embodiment, four ejection port arrays, i.e., an ejection port array 10 ejecting black (Bk) ink, an ejection port array 11 ejecting cyan (C) ink, an ejection port array 12 ejecting magenta (M) ink, an ejection port array 13 ejecting yellow (Y) ink are formed in parallel with one another in the X direction. As described later, printing element arrays are formed in positions in the substrate 14 respectively facing the ejection port arrays 10 to 13. Further, a sub-heater 17 is formed in such a manner as to surround the four ejection port arrays 10 to 13.

Figure 5A:
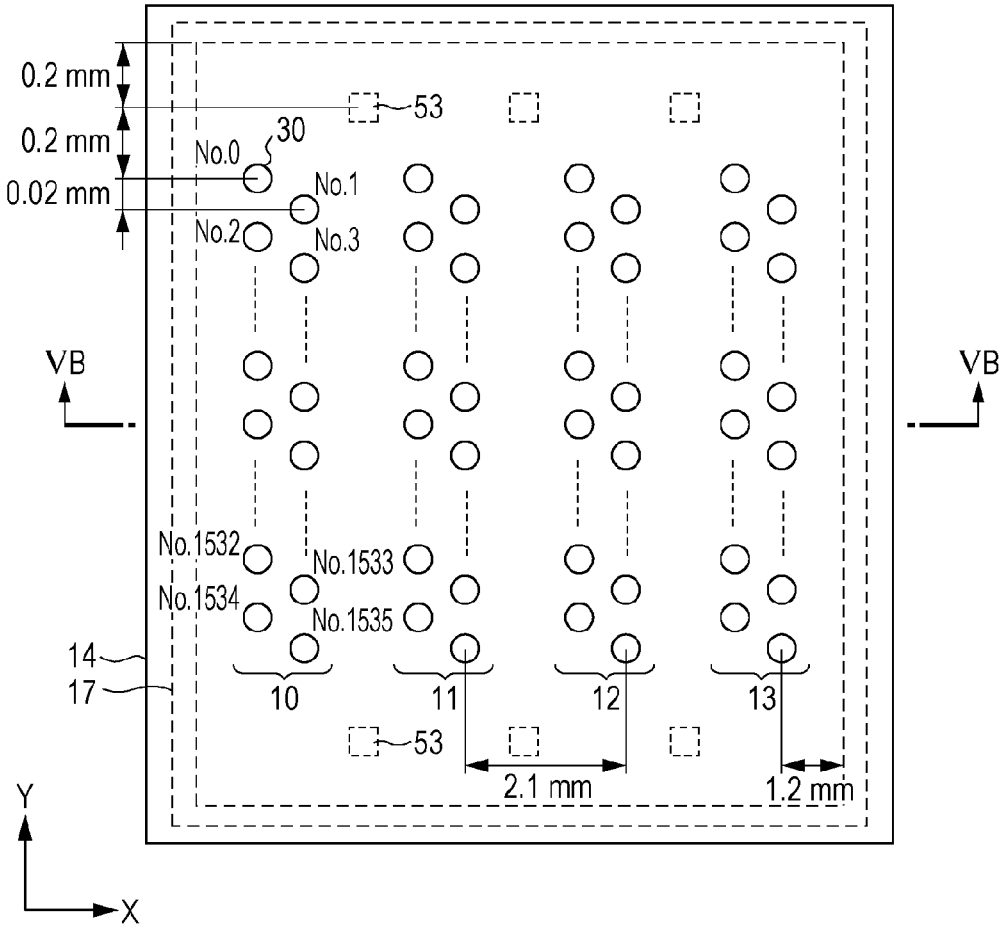
FIGS. 5A and 5B illustrate a perspective view and a sectional view of a printing head according to an embodiment.
Figure 5B:
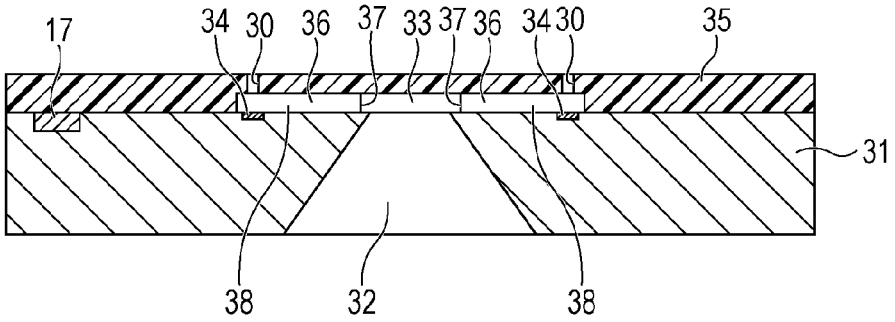

FIG. 5A is a perspective view when the substrate 14 is viewed from a direction perpendicular to the XY plane. FIG. 5B is a sectional view of the substrate 14 near the ejection port array 10 taken along line VB-VB illustrated in FIG. 5A in the vertical direction, viewed from the negative Y-axis direction. Note that, for simplicity, in FIGS. 5A and 5B, dimension ratios different from the actual ones are used for respective portions.

Each of the ejection port arrays 10 to 13 is constituted by two arrays. In a state in which these two arrays facing each other are shifted by one dot with respect to each other for a resolution of 1200 dpi (dots per inch), 768 of ejection ports 30 per array, i.e., a total of 1536 of the ejection ports 30, and 768 of printing elements (hereinafter, also called main heaters) 34 which face the ejection ports and which are electro-thermal conversion elements per array, i.e., a total of 1536 of the printing elements 34, are arranged in the Y direction (predetermined direction). Note that in the present embodiment, 1200 dpi corresponds to a pitch of about 0.02 mm. By applying pulses to a printing element, thermal energy for ejecting ink from an ejection port is generated. Note that, here, the case in which electro-thermal conversion elements are used as printing elements has been described; however, piezoelectric elements, for example, may be used. Temperature sensors (detection elements) 53 made of a diode for detecting the temperature of ink in the vicinity of the printing elements are formed on the substrate 14 in end portions of the ejection port array in the Y direction. Each temperature sensor 53 is formed at a position between two of the ejection port arrays (for example, the ejection port arrays 10 and 11) in the X direction and spaced apart from an ejection port at an end portion by 0.2 mm in the Y direction. The temperature sensors 53 are configured to measure the temperature of the substrate 14 corresponding to the end portions of two ejection port arrays. In the present embodiment, the temperature of the substrate 14 is approximately the same as that of ink in the vicinity of printing elements and, hence, the temperature of the substrate 14 is treated as the temperature of the ink. A heating element (hereinafter, also called a sub-heater) 17 for adjusting the temperature of ink within the ejection ports is formed of a single member and is formed in such a manner as to surround the four ejection port arrays 10 to 13. The heating element 17 is positioned in such a manner as to be 1.2 mm outside of the ejection port array 13 in the X direction, and 0.2 mm outside of the temperature sensor 53 in the Y direction.

The substrate 14 includes a printing element substrate 31 on which the temperature sensors 53, the sub-heater 17, and other various circuits are formed, and an ejection port member 35 formed of a resin. A common ink chamber 33 is formed between the printing element substrate 31 and the ejection port member 35, and an ink supply port 32 communicates with the common ink chamber 33. Ink flow paths 36 extend from the common ink chamber 33, and the common ink chamber 33 communicates with ejection ports 30 formed in the ejection port member 35. On the ejection port 30 side ends of the ink flow paths 36, bubble generation chambers 38 are formed. In the bubble generation chambers 38, the printing elements (main heaters) 34 are arranged at positions facing the ejection ports 30. Nozzle filters 37 are formed between the ink flow paths 36 and the common ink chamber 33.

In the printing head applied to the present embodiment, even when uniform heating is performed through short-pulse heating, the substrate temperature at the center portion in the Y direction is more likely to increase than the substrate temperature at the end portions in the Y-direction. The reason for this is thought to be that although both sides of the center portion of the substrate 14 in the Y direction are adjacent to heated regions (regions including printing elements formed therein), one side of each end portion in the Y-direction is a non-heated region (region including no printing elements formed therein) and, hence, heat can be preferentially released to the non-heated region. Further, it is thought that when a bonding member (not illustrated) bonded to the lower surface of the printing element substrate 31 illustrated in FIG. 5B is formed of alumina or stainless steel having a high thermal capacity, heat dissipation to the atmosphere through the bonding member may be generated.

In the present embodiment, two types of heating control can be performed, i.e., sub-heater heating in which the sub-heater 17 is used to heat ink and short-pulse heating in which short pulses are applied to the printing elements 34 to drive the printing elements 34.

In the sub-heater heating control of the present embodiment, a total of about 10 W of thermal energy is generated by the sub-heater 17 by making a current flow through the sub-heater 17 illustrated in FIG. 5A, whereby, as a result of the thermal energy reaching ink through the substrate 14 and the like, heating of ink near the printing elements is indirectly performed. Note that in the sub-heater heating, heating from the end portions of the printing element arrays in the Y direction is dominant.

In the short-pulse heating control of the present embodiment, ink near the printing elements is directly heated as a result of thermal energy being generated through application of driving pulses with a strength insufficient to cause ink to be ejected to the printing elements 34. Specifically, ink in contact with the printing elements is heated by applying rectangular pulses having a voltage of 24 V and a width of 0.28 μs at a frequency of 10 kHz. In the short-pulse heating control, about 10 W of thermal energy per ejection port array, a total of about 40 W per four port arrays is generated.

As described above, in the present embodiment, the amount of thermal energy (heating power) generated per unit time by the short-pulse heating is higher than the amount of thermal energy (heating power) generated per unit time by the sub-heater heating.

Figure 6:
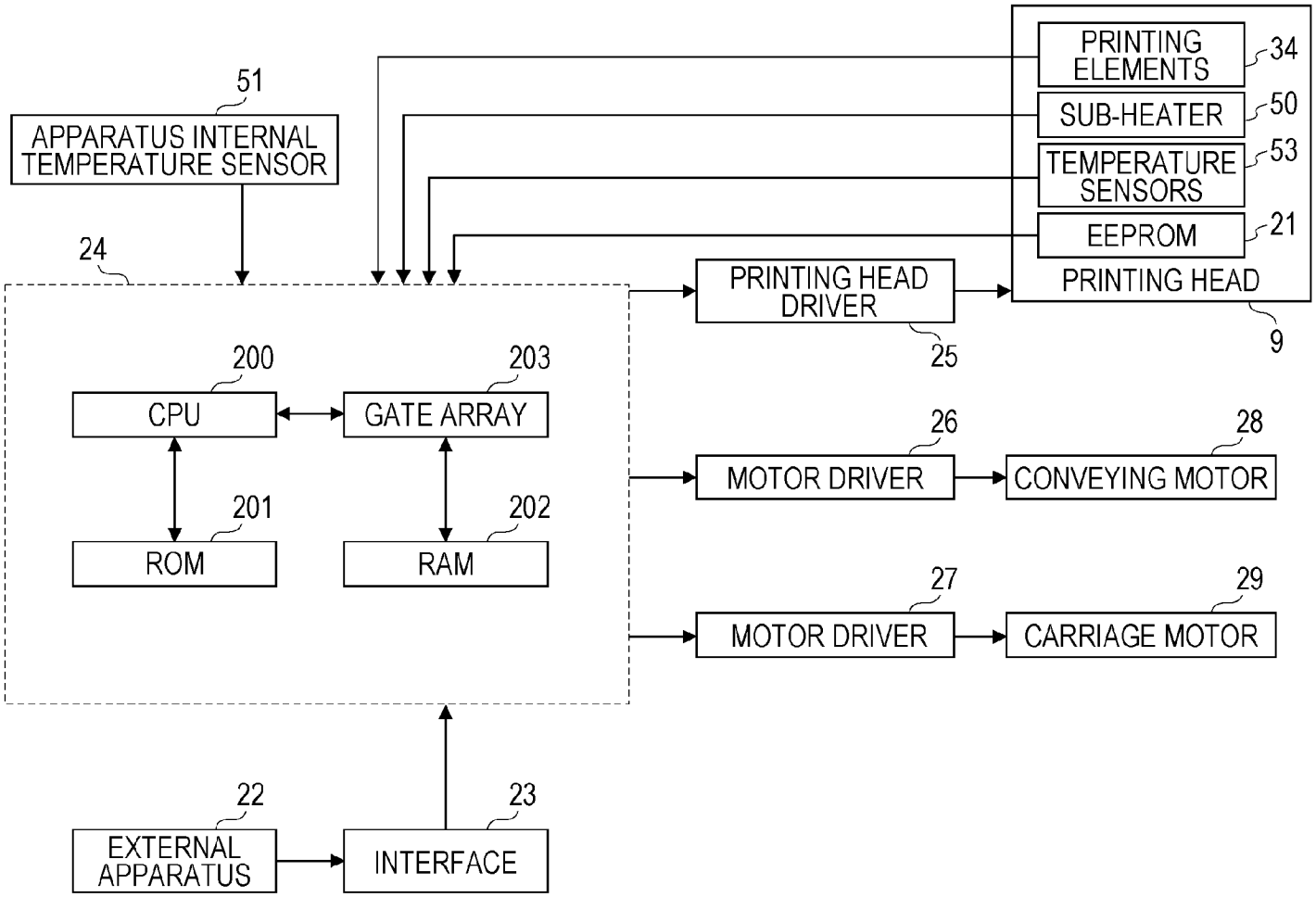
FIG. 6 is a diagram for illustrating a control system according to an embodiment.

FIG. 6 is a block diagram illustrating the control configuration of the inkjet printing apparatus in the present embodiment.

A control system 24 includes a CPU 200, a ROM 201, a RAM 202, a gate array 203. The ROM 201 is used as a storage unit for storing various programs including programs according to the flowcharts illustrated in FIG. 7, FIG. 10, and FIG. 12 described later, and may be used to store a driving pulse table for performing ejection control. The RAM 202 is a storage unit for temporarily storing various data (image data, printing signals supplied to a printing head, and the like). The gate array 203 is used to supply printing signals to the printing head 9, and is also used to transfer data among an interface 23, the CPU 200, and the RAM 202.

A motor driver 27 is used to drive a carriage motor 29 to move the printing head 9 to a predetermined printing position in the X axis in accordance with a signal output from the control system 24. Similarly, in accordance with a signal output from the control system 24, a printing head driver 25 drives the printing head 9. A motor driver 26, in accordance with a signal output from the control system 24, drives a conveying motor 28 to perform an operation of conveying a printing medium.

The printing head 9 includes the temperature sensors 53, a sub-heater 50, and the printing elements 34, and also includes an EEPROM 21 for storing characteristics obtained at the time of a factory test, such as ejection amounts and resistances of heating elements and wiring lines.

The gate array 203 and the CPU 200 of the control system 24 converts image data received from an external apparatus 22 through the interface 23 into print data and stores the print data in the RAM 202. Substrate temperatures within the printing element arrays detected by the temperature sensors 53 and an apparatus internal temperature detected by an apparatus-internal-temperature sensor 51 are also stored in the RAM 202. Further, the control system 24 controls, by driving the motor drivers 26 and 27 and the printing head driver 25 in a synchronized manner, a sub-heater heating operation performed by the sub-heater 50, short-pulse heating operations in the printing elements 34, printing operations performed by the printing head 9, operations of conveying a printing medium, and scanning in the X axis performed by the printing head 9, thereby forming an image on the printing medium P.

In the present embodiment, by using an inkjet printing apparatus having a configuration described above, two types of heating control, i.e., sub-heater heating control and short-pulse heating control are performed in accordance with a predetermined sequence, prior to ejection of ink. Hereinafter, an example sequence of the sub-heater heating control and short-pulse heating control in the present embodiment will be described in detail.

Figure 7:
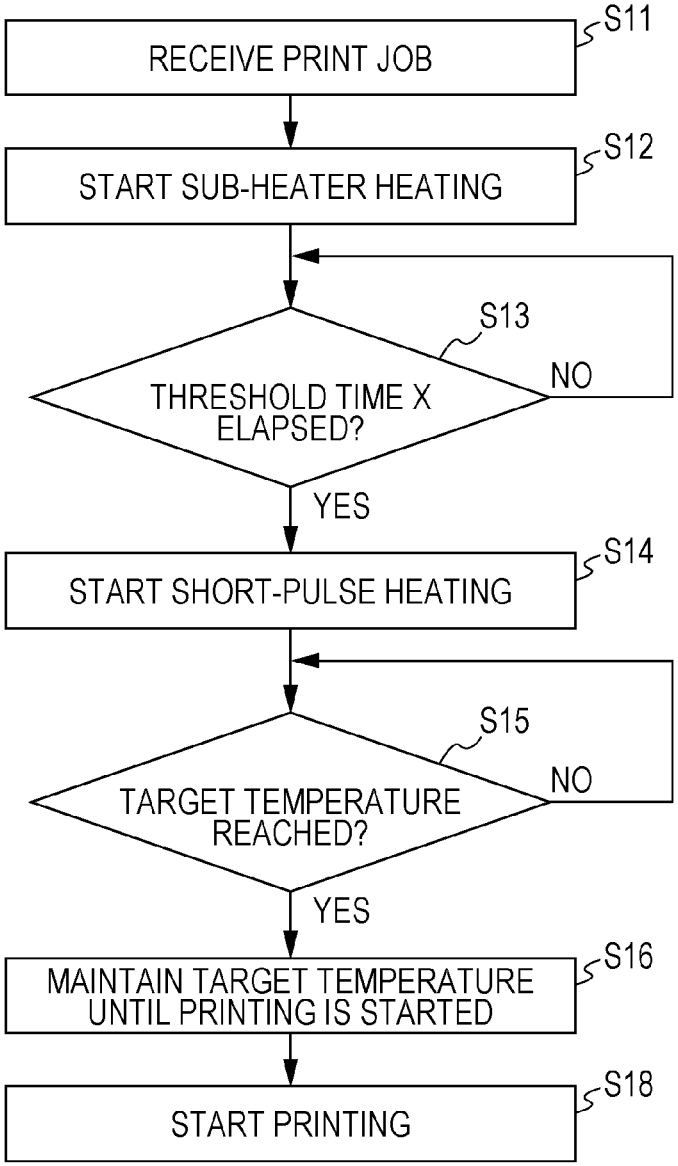
FIG. 7 is a diagram for illustrating heating control in an embodiment.

FIG. 7 is a flowchart of a program executing a sequence of sub-heater heating and short-pulse heating in the present embodiment.

When the inkjet printing apparatus has received a print job in step S11, the heating element 17 is driven at a first time point T1 before starting ejection of ink and sub-heater heating is started, in step S12. Note that sub-heater heating is started immediately after the print job has been received, in the present embodiment.

In step S13, it is determined whether or not a predetermined threshold time X has elapsed from the first time point T1 at which the sub-heater heating was started. Note that the threshold time X is set to one second in the present embodiment.

In step S14, the printing elements 34 are driven by applying driving pulses to the printing elements 34 at a second time point at which the threshold time X has elapsed from the first time point T1, whereby short-pulse heating is started. In heating control after this, the sub-heater heating and short-pulse heating are both performed.

In step S15, in each of the ejection port arrays 10 to 13, the substrate temperature is detected by a temperature sensor at predetermined time intervals, and it is determined whether or not the substrate temperature has reached a target temperature. In the present embodiment, the target temperature is set to 40° C., and the predetermined time interval is set to 0.1 second. When it is determined that the target temperature has not been reached, the sub-heater heating and short-pulse heating continue to be performed. When it is determined that the target temperature has been reached, the on/off control of the sub-heater heating and the short-pulse heating is continued until the target temperature is reached in all the four ejection port arrays 10 to 13 in step S16, and when it is determined that the target temperature has been reached in all the ejection port arrays, printing is started in step S18.

Figure 8A:
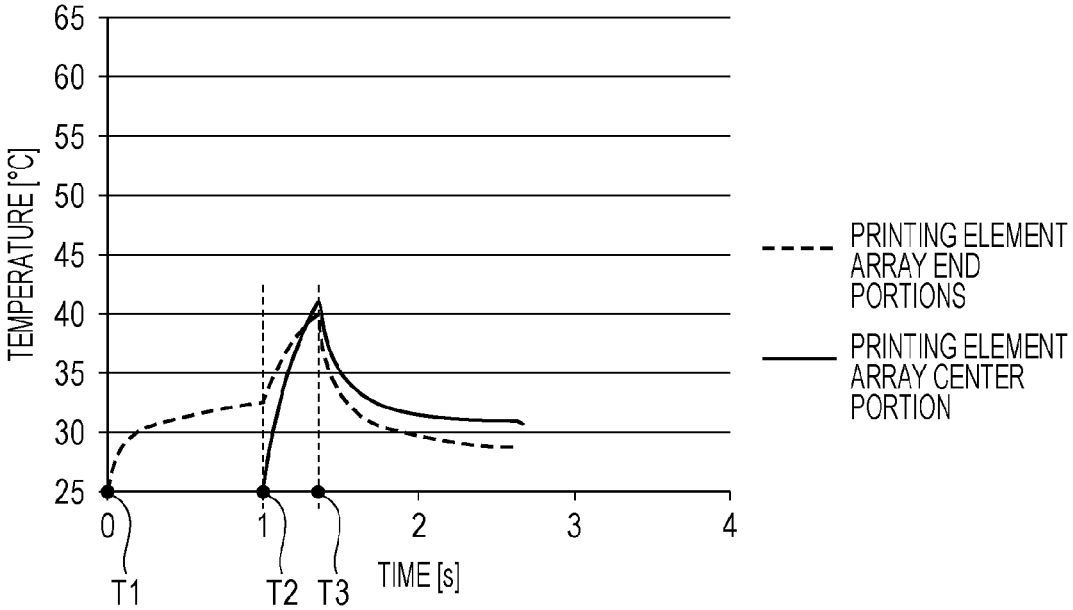
FIGS. 8A and 8B are diagrams for illustrating a change in temperature and the temperature distribution within a printing element array in an embodiment.
Figure 8B:
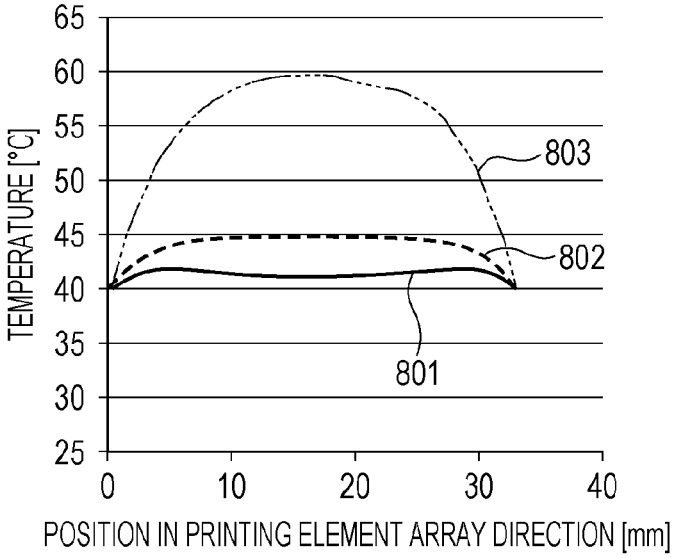

FIGS. 8A and 8B are diagrams for explaining a change in the substrate temperature and the temperature distribution when ink is heated in accordance with the sequence illustrated in FIG. 7. FIG. 8A is a diagram illustrating the temperature of the substrate versus time for the case in which ink is heated in accordance with the sequence illustrated in FIG. 7. FIG. 8B is a diagram illustrating the substrate temperature distribution within a printing element array at a third time point T3 at which the substrate temperature at the end portions of the printing element array detected by the temperature sensors 53 reaches the target temperature. Here, a case will be described in which the apparatus internal temperature near the printing head in the inkjet printing apparatus is about 25° C.

First, sub-heater heating is performed in step S12 illustrated in FIG. 7, at the first time point T1 immediately after a print job has been received. As described above, thermal energy generated by driving the sub-heater 17 is intensively given to the end portions of the substrate in the Y direction and, hence, only the substrate temperature at the end portions of the printing element arrays increases for a while after the first time point T1.

After a second time point T2 at which one second, which is the threshold time X, has elapsed from the first time point T1, the short-pulse heating is also performed in step S14 illustrated in FIG. 7. Since driving pulses are uniformly applied to printing elements in a printing element array, thermal energy due to this short-pulse heating is uniformly supplied within the printing element array. However, since heat dissipation is outstanding at the end portions of the substrate in the Y direction, the center portion of the substrate in the Y direction is more likely to increase after the second time point T2.

Hence, the substrate temperature at the end portions of the printing element arrays is approximately the same as the substrate temperature at the center portions of the printing element arrays, at the third time point T3 when a certain time has elapsed from the second time point T2, information about the substrate temperature at the end portions of the printing element arrays detected by the temperature sensors 53 is obtained, and the substrate temperature indicated by the obtained information reaches the target temperature of 40° C.

Figure 1A:
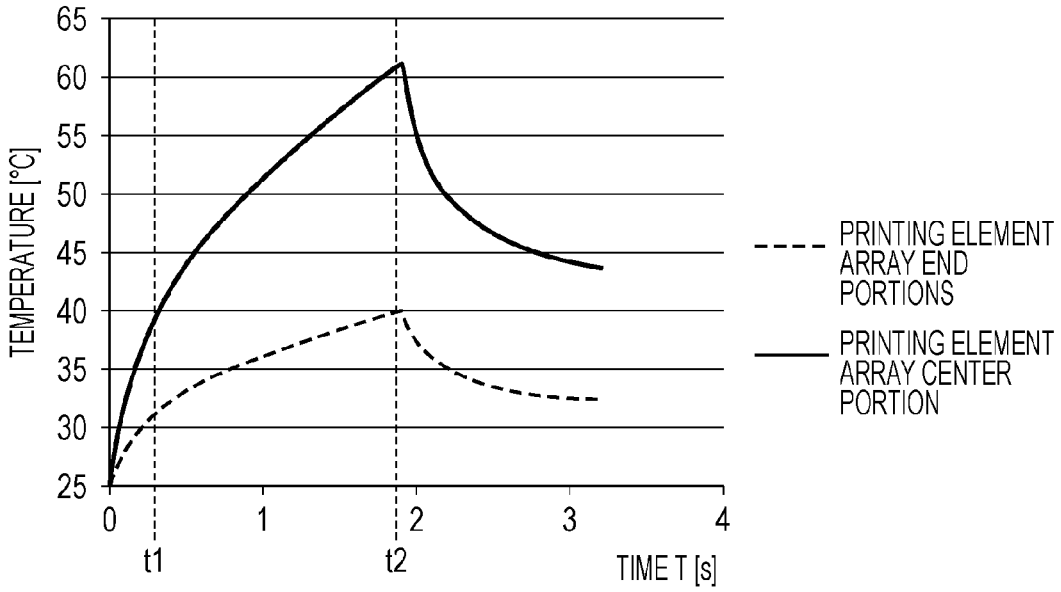
FIGS. 1A and 1B are diagrams for illustrating a change in temperature and the temperature distribution within a printing element array.
Figure 1B:
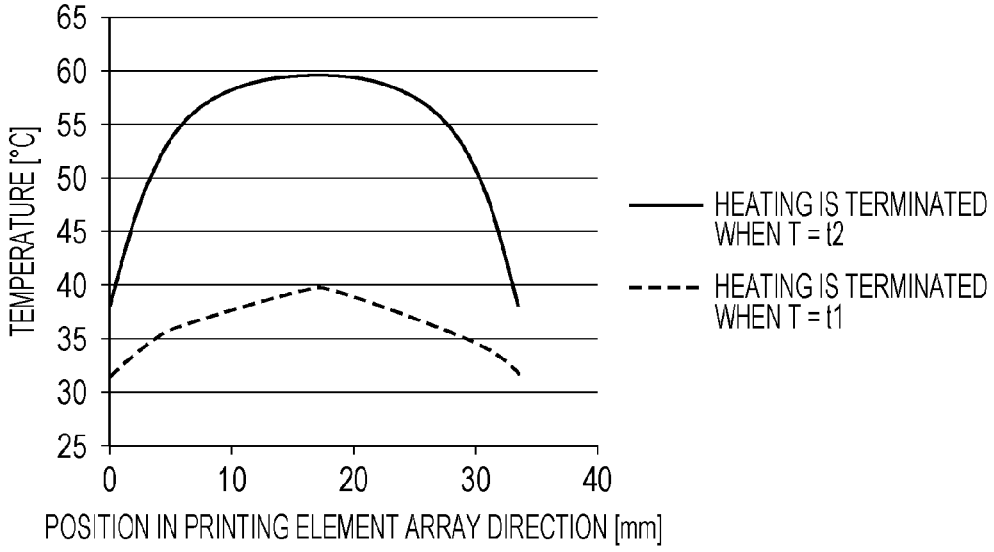
Figure 2A:
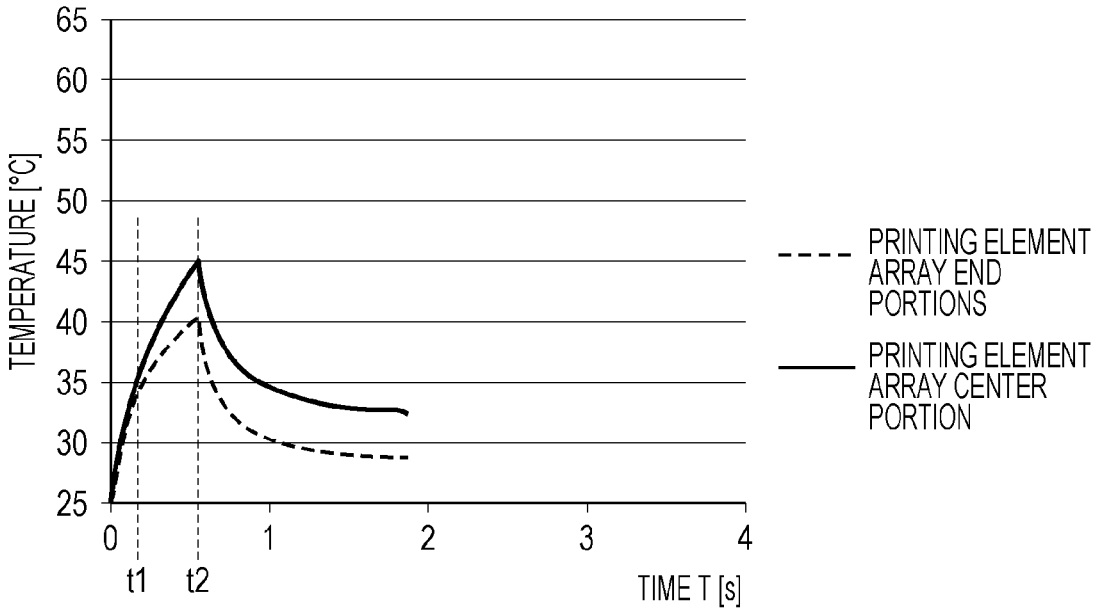
FIGS. 2A and 2B are diagrams for illustrating a change in temperature and the temperature distribution within a printing element array.
Figure 2B:
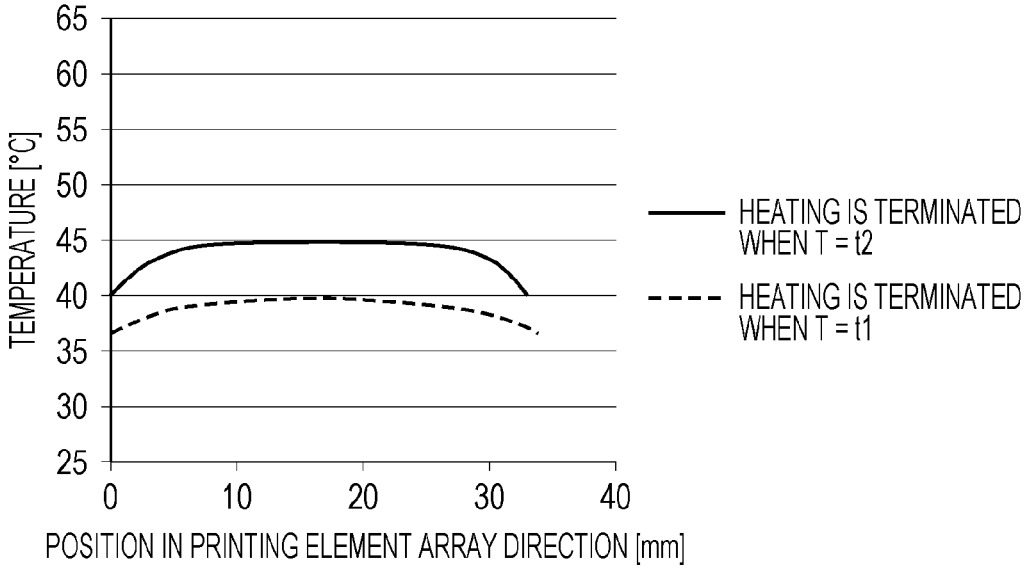

The substrate temperature distribution within the printing element arrays observed when the heating control in the present embodiment is performed is illustrated using a solid line 801 in FIG. 8B. Note that a broken line 803 in FIG. 8B corresponds to the substrate temperature distribution observed when ink is heated only by the short-pulse heating illustrated in FIG. 1B. A broken line 802 in FIG. 8B corresponds to the substrate temperature distribution observed when the short-pulse heating and sub-heater heating illustrated in FIG. 2B are performed at the same time.

As can be seen from FIG. 8B, by performing sub-heater heating in advance prior to execution of short-pulse heating, the substrate temperature distribution within a printing element array can be made to be uniform and overshooting can be suppressed.

As described above, according to the present embodiment, printing can be performed while suppressing variations in ejection volume and a decrease in the durability of a printing head.

Note that the substrate temperature distribution within a printing element array can be made to be uniform also when, for example, short-pulse heating and sub-heater heating are started at the same time, and subsequently, at a predetermined time point, the short-pulse heating is terminated and the sub-heater heating is continued. However, in this case, since only the sub-heater heating is performed after the predetermined time point, heating is not performed so much at the center portion of the printing element array. Hence, unless short-pulse heating is performed until the substrate temperature at the center portion of the printing element array becomes a target temperature or higher, that is, a temperature at which overshooting may possibly be generated, the substrate temperature at the center portion of the printing element array may finally become lower than the target temperature due to heat dissipation subsequent to the predetermined time point.

Second Embodiment

In the first embodiment, description has been made regarding a case in which an apparatus internal temperature near a printing head within an inkjet printing apparatus is a specific temperature (25° C.)

On the other hand, in the present embodiment, a case in which control is performed by detecting the apparatus internal temperature near the printing head will be described.

Note that the descriptions of portions similar to those in the first embodiment described above are omitted.

When an apparatus internal temperature near the printing head is relatively low, considerable heat dissipation is generated. Hence, for example, when ink is heated only by short-pulse heating, the temperature distribution within a printing element array has a steep curve. In view of the above points, in the present embodiment, when the apparatus internal temperature is low, the duration of sub-heater heating is made longer than in the case in which the apparatus internal temperature is high, thereby increasing thermal energy supplied to ink near the printing elements at the end portions of a printing element array.

Hereinafter, detailed description based on experiment results will be made regarding the fact that, by making the duration of sub-heater heating long in the case in which the apparatus internal temperature is low, a non-uniform temperature distribution within the printing element array is avoided.

Figure 9A:
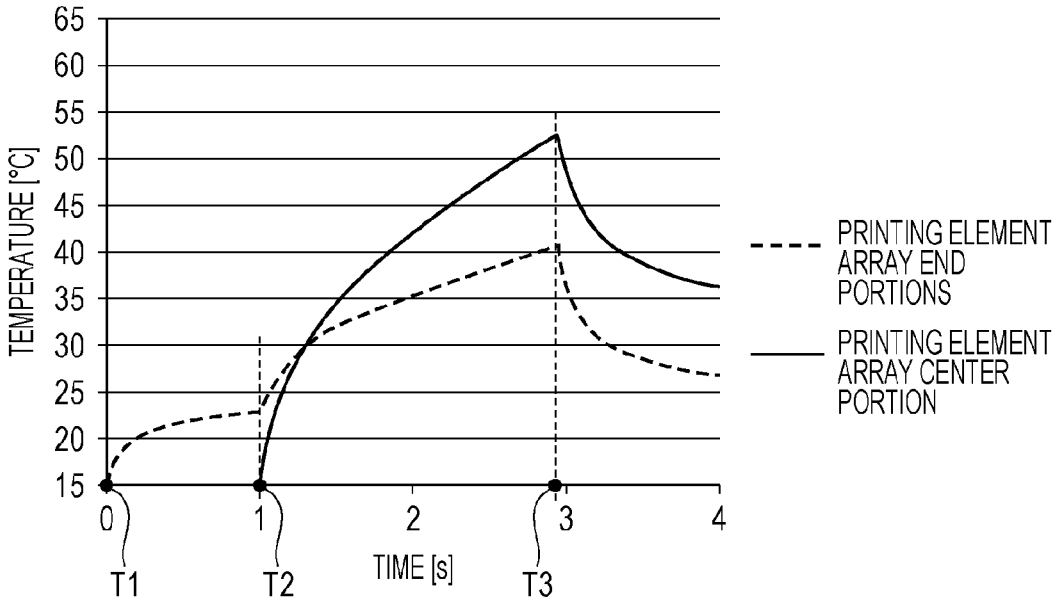
FIGS. 9A and 9B are diagrams for illustrating a correlation between an apparatus internal temperature and a temperature distribution within a printing element array.
Figure 9B:
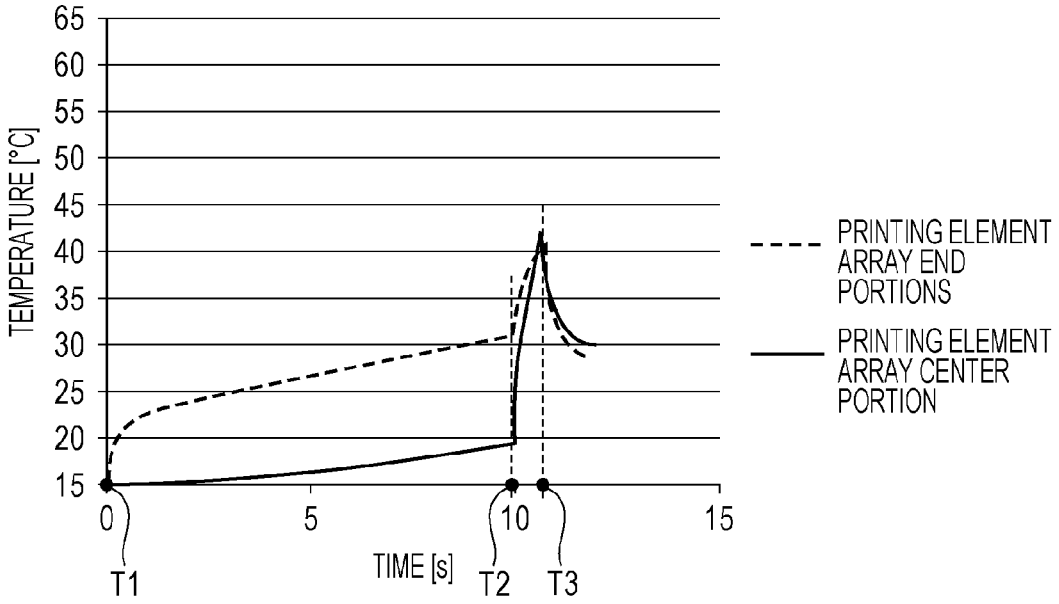

FIGS. 9A and 9B are diagrams for illustrating a change in substrate temperature in the case where heating is performed in accordance with the sequence illustrated in FIG. 7, when the apparatus internal temperature is 15° C. FIG. 9A illustrates the change in temperature when the threshold time X is one second, and FIG. 9B illustrates the change in temperature when the threshold time X is 10 seconds.

As illustrated in FIG. 8A, when the apparatus internal temperature is 25° C., by setting the time interval (threshold time X) between the first time point T1 at which sub-heater heating is started and the second time point T2 at which short-pulse heating is started to one second, the temperature of the end portions of the printing element array can be made to be about the same as the temperature of the center portion of the printing element array at the third time point T3 at which the substrate temperature at the end portions of the printing element array reaches a target temperature (40° C.)

On the other hand, when the apparatus internal temperature is 15° C., heat dissipation at the end portions of the printing element array is considerable. Hence, as can be seen from FIG. 9A, the end portions of the printing element array cannot be sufficiently heated by the sub-heater heating in the case in which the time interval (threshold time X) between the first and second time points T1 and T2 is set to one second, whereby an overshoot phenomenon is generated at the center portion of the printing element array at the third time point T3.

Compared to this, in the case in which the time interval (threshold time X) between the first and second time points T1 and T2 is set to 10 seconds, the end portions of the printing element array can be sufficiently heated. As a result, at the third time point T3, the temperature of the end portions of the printing element array can be made to be about the same as the temperature of the center portion of the printing element array.

In view of the above points, in the present embodiment, the difference between the first and second time points T1 and T2 (threshold time X) is determined on the basis of the apparatus internal temperature.

Figure 10:
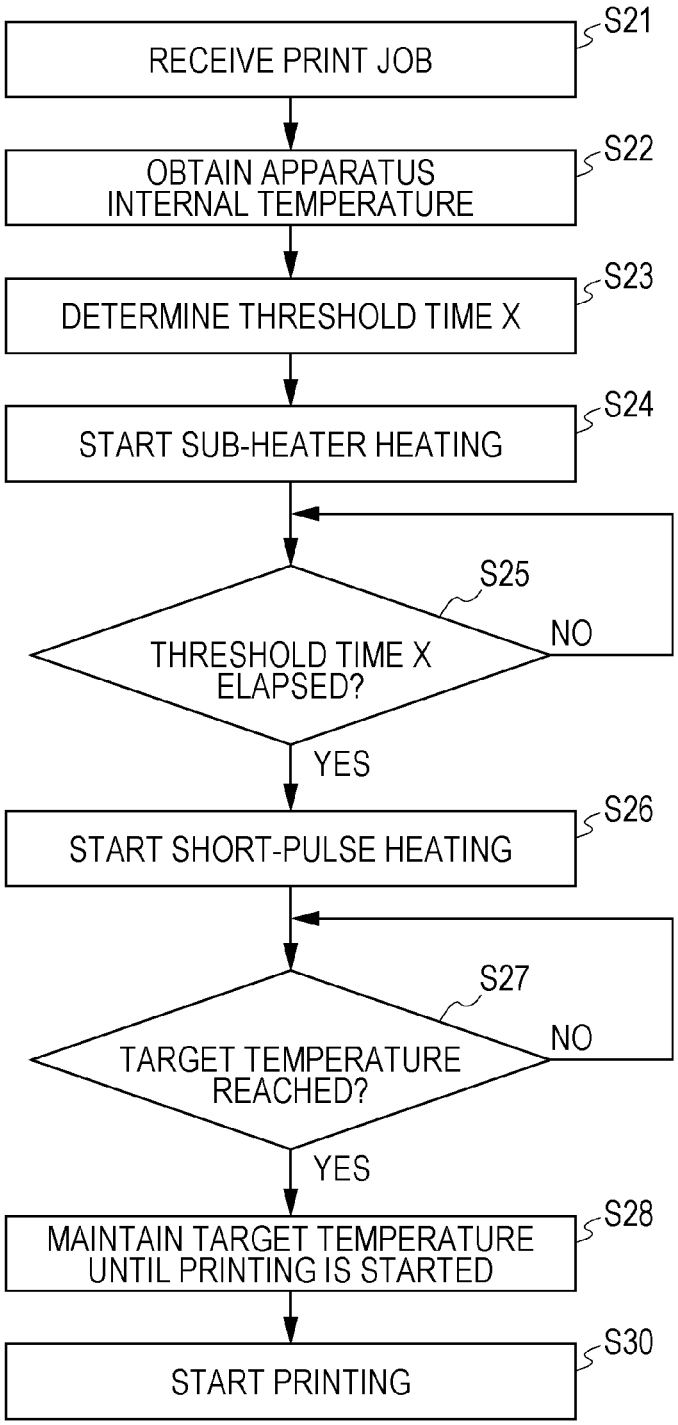
FIG. 10 is a diagram for illustrating heating control in an embodiment.

FIG. 10 is a flowchart of a program that executes a sequence of sub-heater heating and short-pulse heating in the present embodiment.

Since step S21, step S24 to step S28, and step S30 in the present embodiment are respectively the same as step S11, step S12 to step S16, and step S18 in FIG. 7 in the first embodiment, the description thereof is omitted.

In step S22, the apparatus internal temperature near the printing head within the inkjet printing apparatus detected by the apparatus-internal-temperature sensor 51 provided in the inkjet printing apparatus is obtained.

In step S23, the threshold time X is determined on the basis of the apparatus internal temperature obtained in step S22. Note that the processing performed in step S23 will be described later.

FIG. 11 is a table for explaining the method of determining the threshold time X performed in step 23 illustrated in FIG. 10.

In the present embodiment, an appropriate threshold time X is selected from 11 candidate times in accordance with the apparatus internal temperature. This table is set in such a manner that the lower the apparatus internal temperature, the longer the selected threshold time X.

For example, when the apparatus internal temperature is 25° C., the threshold time X is set to one second. Hence, as illustrated in FIG. 8A, heating can be performed in such a manner that the substrate temperature at the end portions of a printing element array becomes about the same as the substrate temperature at the center portion, at the third time point T3 when the substrate temperature at the end portions of the printing element array reaches the target temperature. On the other hand, when the apparatus internal temperature is 15° C., the threshold time X is set to 10 seconds. As a result, as illustrated in FIG. 9B, heating can be controlled in such a manner that the substrate temperature at the end portions of the printing element array becomes about the same as the substrate temperature at the center portion, at the third time point T3.

As described above, according to the present embodiment, it becomes possible to change a period in which only the sub-heater heating is performed in accordance with the apparatus internal temperature. As a result, printing can be performed while more effectively suppressing variations in ejection volume and a decrease in the durability of the printing head.

Third Embodiment

In the first and second embodiments, configurations have been described in which short-pulse heating is started after a threshold time has elapsed from the time when sub-heater heating was started.

On the other hand, in the present embodiment, an embodiment will be described in which short-pulse heating is started after a temperature detected by the temperature sensor 53 has increased by a threshold amount of temperature rise.

Note that the descriptions of portions similar to those in the second embodiment are omitted.

As described above, for example, when heat dissipation is likely to occur at the end portions of a printing element array, thermal energy may be provided to the end portions through sub-heater heating that mainly heats the end portions, to regulate the temperature distribution. Here, the lower the temperature of the end portions, the more the thermal energy to be provided to the end portions. In the first and second embodiments, the duration of sub-heater heating was controlled to control thermal energy provided to the end portions. However, in the present embodiment, control is performed on the basis of a temperature rise amount at the end portions subsequent to the start of sub-heater heating.

For example, as can be seen from the second time point T2 illustrated in FIG. 8A, in the case where the apparatus internal temperature is 25° C., the end portions and the center portion will have about the same temperature at the third time point T3 if the short-pulse heating is started when the amount of temperature rise at the end portions becomes about 7.5° C. (=32.5° C.−25° C.). Similarly, as can be seen from the second time point T2 illustrated in FIG. 9B, in the case where the apparatus internal temperature is 15° C., the end portions and the center portion will have about the same temperature at the third time point T3 if the short-pulse heating is started when the amount of temperature rise at the end portions becomes about 15° C. (=30° C.−15° C.)

In view of the above points, in the present embodiment, generation of a non-uniform temperature distribution in a printing element array is suppressed by determining the threshold temperature rise amount in accordance with the apparatus internal temperature.

Figure 12:
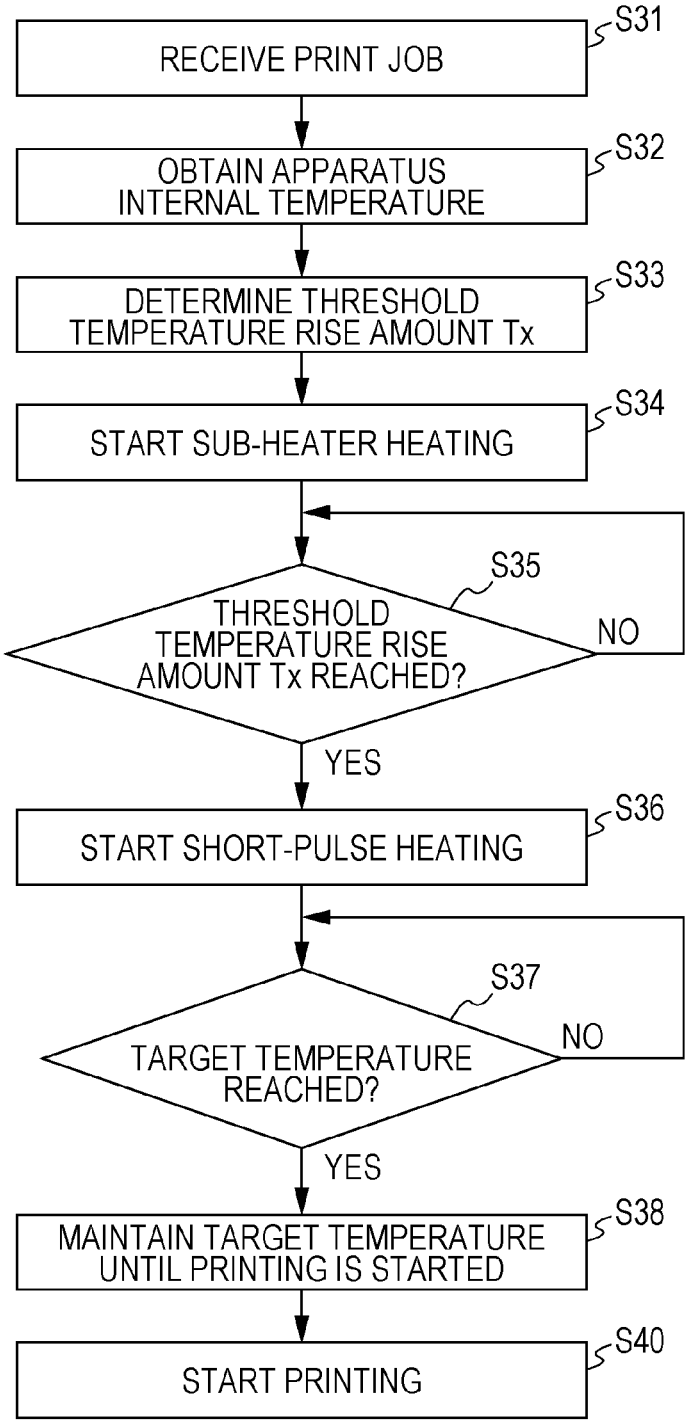
FIG. 12 is a diagram for illustrating heating control in an embodiment.

FIG. 12 is a flowchart of a program that executes a sequence of sub-heater heating and short-pulse heating in the present embodiment.

Since steps S31 and S32, step S34, step S36 to step S38, and step S40 in the present embodiment are respectively the same as steps S21 and S22, step S24, step S26 to step S28, and step S30 in FIG. 10 in the second embodiment, the description thereof is omitted.

In step S33, a threshold temperature rise amount Tx is determined on the basis of the apparatus internal temperature obtained in step S32. Note that this processing performed in step S33 will be described later.

In step S35, it is determined whether or not the substrate temperature detected by the temperature sensor 53 has increased by the threshold temperature rise amount Tx determined in step S33 since sub-heater heating was started at the first time point T1. When it is determined that the temperature has increased by the threshold temperature rise amount Tx, the flow proceeds to step S36, where short-pulse heating is started.

FIG. 13 is a table for explaining the method of determining the threshold temperature rise amount Tx performed in step S33 illustrated in FIG. 12.

In the present embodiment, an appropriate threshold temperature rise amount Tx is selected from among 11 candidate amounts of temperature rise in accordance with the apparatus internal temperature. This table is set in such a manner that the lower the apparatus internal temperature, the higher the selected threshold temperature rise amount Tx.

For example, when the apparatus internal temperature is 25° C., the threshold temperature rise amount Tx is set to 7.5° C. On the other hand, when the apparatus internal temperature is 15° C., the threshold temperature rise amount Tx is set to 15° C. As a result, heating can be controlled in such a manner that the substrate temperature at the end portions of a printing element array becomes about the same as the substrate temperature at the center portion, at the third time point T3 when the substrate temperature at the end portions of the printing element array reaches the target temperature.

As described above, according to the present embodiment, it becomes possible to change a period in which only the sub-heater heating is performed in accordance with the apparatus internal temperature. As a result, printing can be performed while effectively suppressing variations in ejection volume and a decrease in the durability of a printing head.

Fourth Embodiment

In the first to third embodiments, configurations have been described in which the amount of thermal energy generated by short-pulse heating per unit time is larger than the amount of thermal energy generated by sub-heater heating per unit time.

On the other hand, in the present embodiment, a configuration is described in which the amount of thermal energy generated by sub-heater heating per unit time is larger than the amount of thermal energy generated by short-pulse heating per unit time.

Note that the descriptions of portions that are the same as those in the first to third embodiments described above are omitted.

Figure 14:
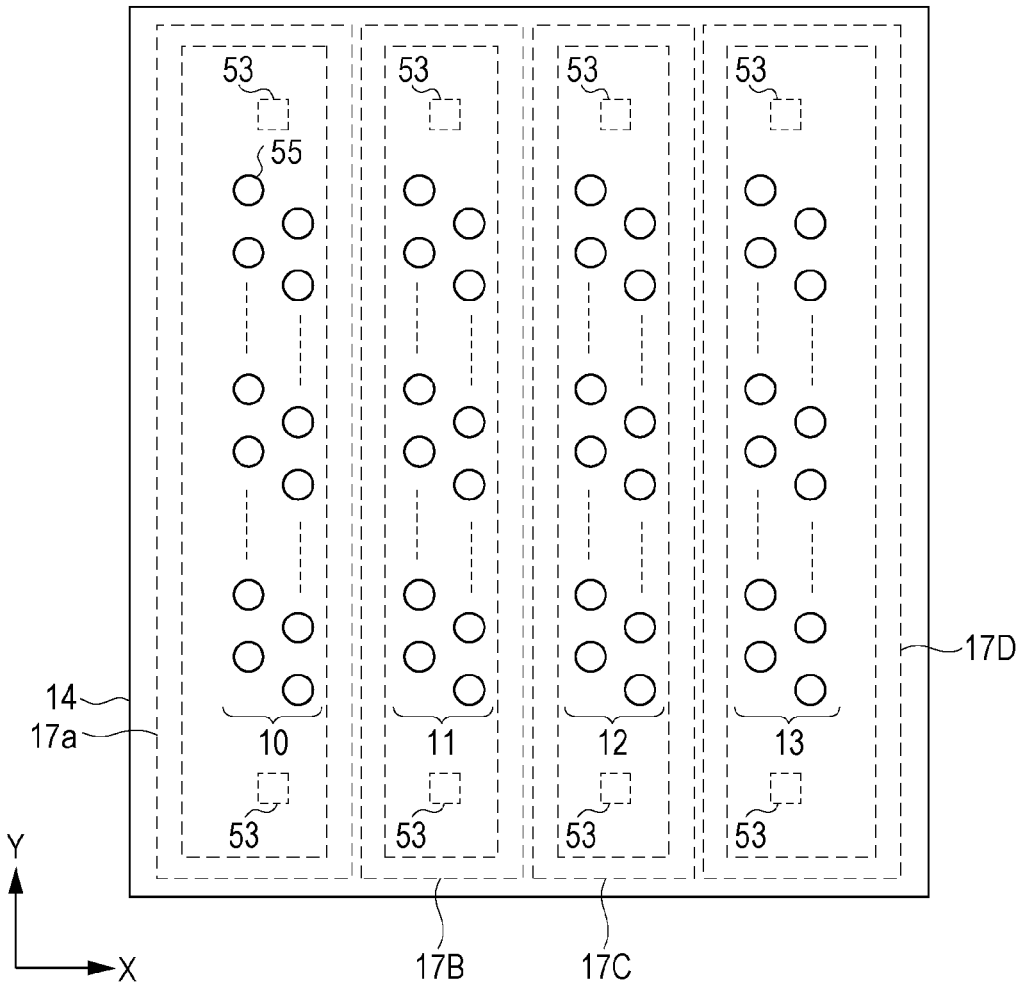
FIG. 14 is a perspective view of a printing head according to an embodiment.

FIG. 14 is a perspective view when the substrate 14 of a printing head used in the present embodiment is viewed from a direction perpendicular to the XY plane.

In the present embodiment, four sub-heaters 17A, 17B, 17C, and 17D are respectively formed of continuous members so as to respectively surround the ejection port arrays 10, 11, 12, and 13. The temperature sensors 53 are formed on the two ends of each of the ejection port arrays 10 to 13 in the Y direction.

Here, in the sub-heater heating control in the present embodiment, by making a current flow through each of the sub-heaters 17A, 17B, 17C, and 17D illustrated in FIG. 14, about 15 W of thermal energy is generated in each sub-heater. Hence, a total of about 60 W of thermal energy is generated by the sub-heater heating.

In the short-pulse heating control in the present embodiment, thermal energy is generated through application of driving pulses having a strength insufficient to allow ink to be ejected to the printing elements 34, thereby heating ink near the printing elements. Specifically, rectangular pulses having a voltage of 24 V and a width of 0.28 μs at a frequency of 10 kHz are applied to the printing elements. In the short-pulse heating control, about 10 W of thermal energy per ejection port array, a total of about 40 W per four ejection port arrays, is generated.

In this manner in the present embodiment, the amount of thermal energy (60 W) per unit time generated by the sub-heater heating is larger than the amount of thermal energy (40 W) per unit time generated by the short-pulse heating. Hence, in the present embodiment, control is performed in such a manner that the short-pulse heating is started before starting the sub-heater heating that generates relatively large amount of thermal energy.

Figure 15:
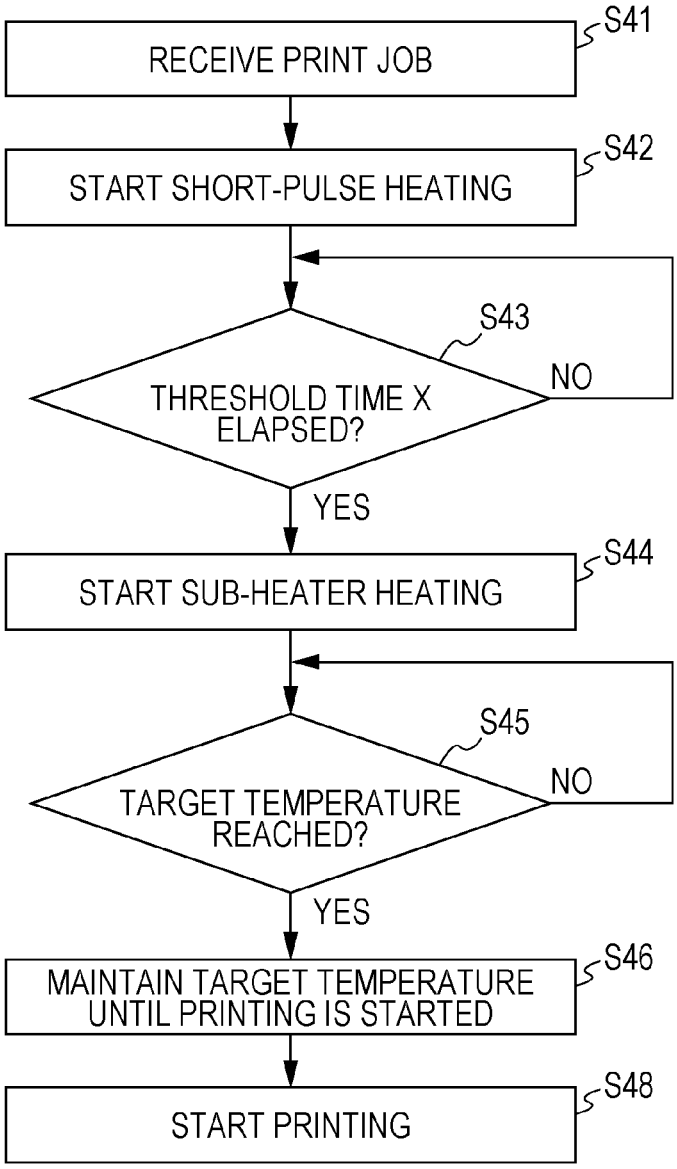
FIG. 15 is a diagram for illustrating heating control in an embodiment.

FIG. 15 is a flowchart for explaining the sequence of sub-heater heating and short-pulse heating in the present embodiment.

When the inkjet printing apparatus has received a print job (step S41), short-pulse heating is first started (step S42). When the threshold time X has elapsed since the short-pulse heating was started (step S43), sub-heater heating is then started (step S44). After this, the short-pulse heating and the sub-heater heating are used together. When heating to a target temperature has been performed (step S45), it is determined whether or not all the four ejection port arrays have reached the target temperature (step S46). When it is determined that the target temperature has not been reached, the on/off control of the sub-heater heating and short-pulse heating is continued. When it is determined that all the ejection port arrays have reached the target temperature, printing is started (step S48).

Figure 16A:
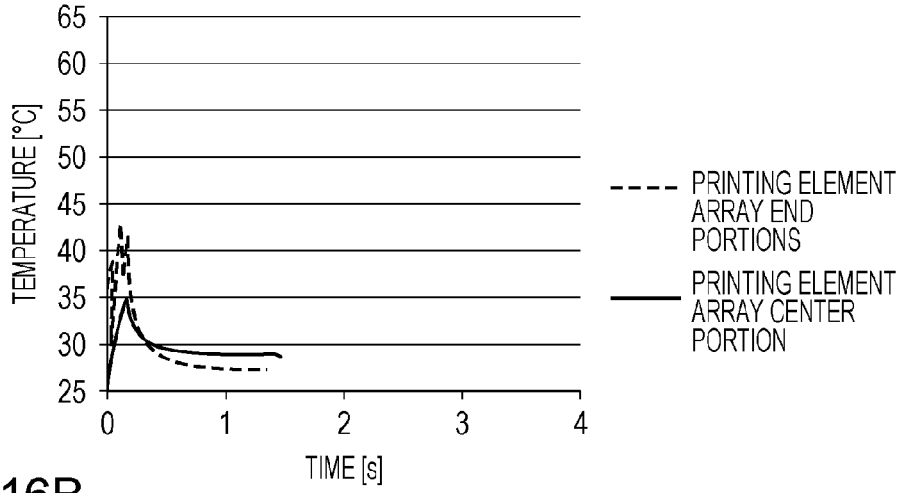
FIGS. 16A, 16B, and 16C are diagrams for illustrating a change in temperature and the temperature distribution within a printing element array in an embodiment.
Figure 16B:
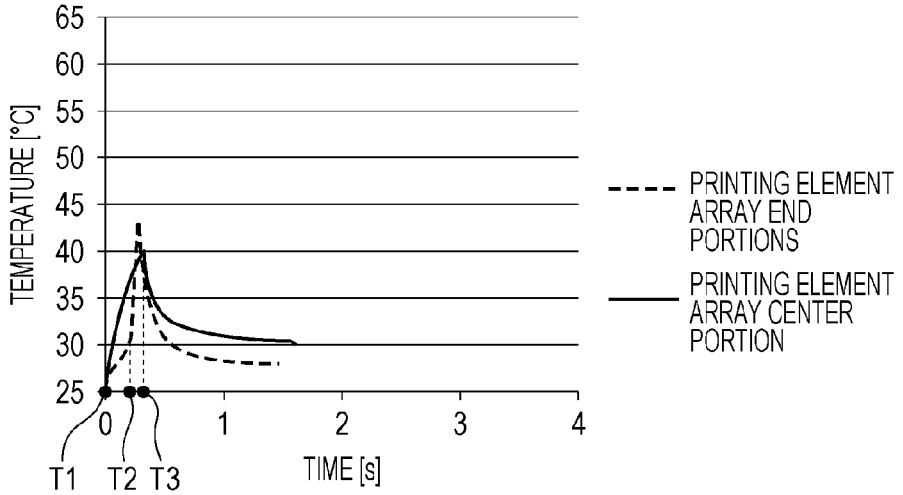
Figure 16C:
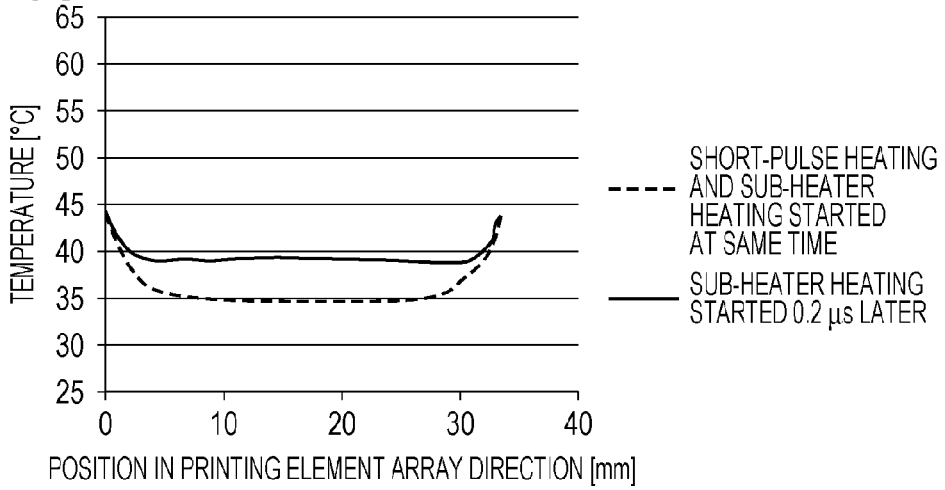

FIGS. 16A to 16C are diagrams illustrating a change in temperature and a temperature distribution in the case where heating has been performed before printing is started in accordance with the sequence illustrated in FIG. 15. Note that the case in which the apparatus internal temperature is 25° C. is illustrated here.

FIGS. 16A and 16B are diagrams illustrating, respectively for the cases in which the threshold time X is 0 seconds and 0.2 second, the substrate temperature at the end portions of a printing element array vs. time and the substrate temperature at the center portion of the printing element array vs. time. FIG. 16C illustrates the substrate temperature distribution of the printing element array in the case where the target temperature of 40° C. has been reached in FIGS. 16A and 16B. As can be seen from FIG. 16A, when short-pulse heating and sub-heater heating are started at the same time, the end portions of a printing element array reach the target temperature earlier than the center portion of the printing element array does, while the center portion of the printing element array has not reached the target temperature. On the other hand, in the case of FIG. 16B, the center portion of the printing element array is preferentially heated while short-pulse heating is performed in advance, and as a result, there are almost no temperature differences between the end portions and center portion of the printing element array at the time when the target temperature has been reached. Further, it can be seen from FIG. 16C that the temperature distribution of the printing element array is regulated, compared with the case in which short-pulse heating and sub-heater heating are started at the same time.

As described above, according to the present embodiment, the temperature distribution of a printing element array can be regulated also in the case in which sub-heater heating is more dominant than short-pulse heating.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Figure 17:
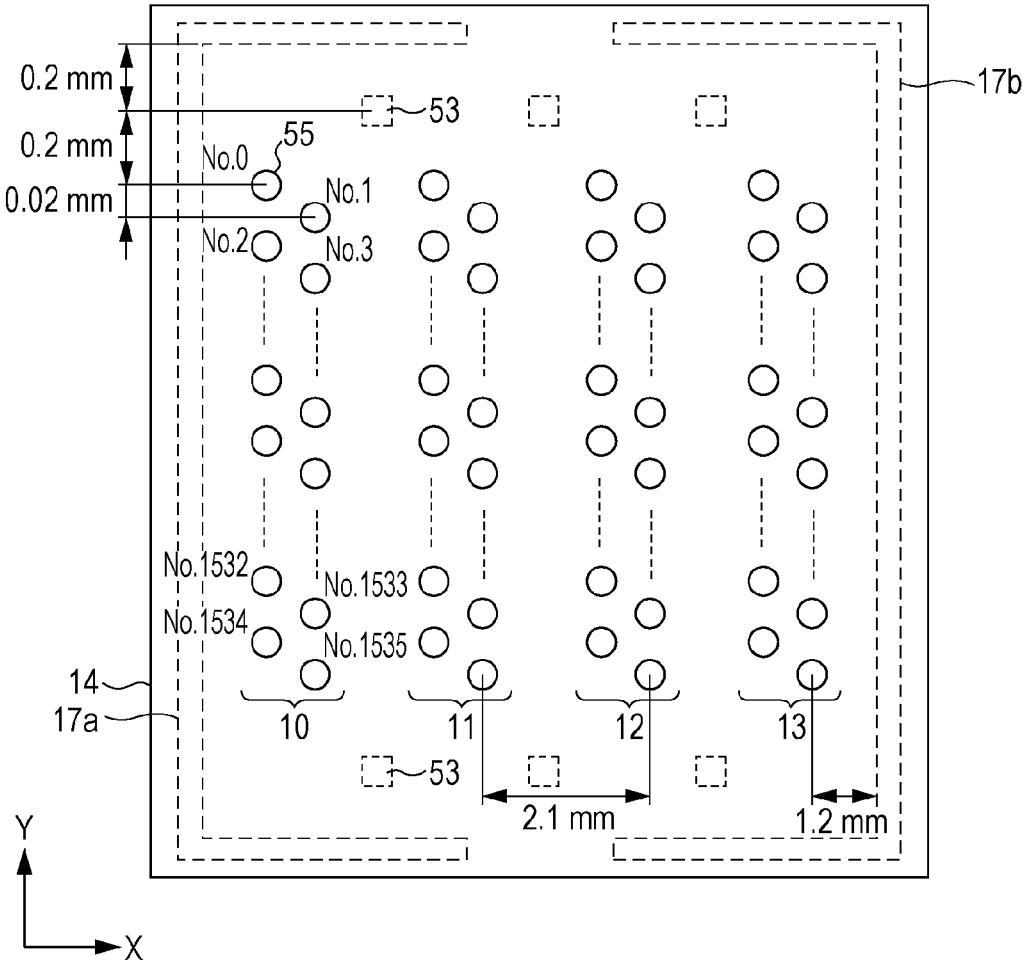
FIG. 17 is a perspective view of a printing head according to an embodiment.

Although the printing head has a configuration in which a sub-heater is arranged in such a manner as to surround the ejection port arrays 10 to 13 or each of the ejection port arrays 10 to 13 in the embodiments described above, other configurations may be used. For example, a similar effect is obtained with a configuration in which sub-heaters are arranged only in the end portions of the ejection port arrays in the Y direction. Further, another configuration may be employed in which a sub-heater is constituted of a plurality of separate sub-heaters. For example, a similar effect is obtained in the case of using a sub-heater 17*a* provided in such a manner as to surround one side of the ejection port arrays 10 and 11 in the X direction and a sub-heater 17*b* provided in such a manner as to surround the other side of the ejection port arrays 12 and 13 in the X direction, as illustrated in FIG. 17.

In the embodiments described above, description has been made regarding a case in which the substrate temperature is detected to obtain the temperature of ink near the printing elements and in which the condition that the substrate and ink have about the same temperature is satisfied, but other embodiments may be possible. For example, the present invention can also be applied to a configuration that includes a temperature sensor that can directly detect the temperature of ink near the printing elements.

In the embodiments described above, description has been made regarding a case in which an image is printed by scanning a printing medium multiple times, but other embodiments may be possible. For example, the embodiments can also be applied to a configuration in which, by using a long printing head longer than the width of a printing medium, an image is printed by ejecting ink from the printing head while conveying the printing medium only once in the direction perpendicular to the width direction.

In the embodiments described above, description has been made regarding an inkjet printing apparatus and an inkjet printing method, but the embodiments may include an image processing apparatus, an image processing method, a computer, and the like for generating data used to perform an inkjet printing method described in the embodiments. Further, the present invention can be widely applied to a configuration in which programs for making the inkjet printing apparatus function are provided in a unit different from the inkjet printing apparatus, a configuration in which these programs are provided in a unit which is part of the inkjet printing apparatus, and the like.

According to the inkjet printing apparatus, inkjet printing method, and non-transitory computer-readable storage medium in accordance with an example of the present invention, printing is realized in which variations in ejection volume and a decrease in the durability of a printing head due to a temperature distribution within a printing element array is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-125610, filed Jun. 18, 2014, which is hereby incorporated by reference herein in its entirety.

What is claimed is:

1. An inkjet printing apparatus comprising:

a printing head including a substrate including at least a printing element array in which a plurality of printing elements for generating thermal energy used to eject ink from ejection ports are arranged in a predetermined direction and a heating element for heating ink near the printing elements, the heating element being provided near at least one end portion of the printing element array in the predetermined direction;

a heating control unit that causes an execution of a first heating that heats ink near the printing elements by causing the heating element to generate a first amount of thermal energy per unit time to drive the printing element and an execution of a second heating that heats ink near the printing elements by causing the printing elements to generate a second amount of thermal energy per unit time larger than the first amount by driving the printing elements to an extent insufficient to cause ink to be ejected from the ejection ports; and a printing control unit that performs control in such a manner that ink ejection from the printing head is started when a temperature of ink near the printing elements reaches a predetermined temperature as a result of the first and second heating caused by the heating control unit, wherein the heating control unit starts driving the heating element at a first time point and starts driving the printing elements at a second time point subsequent to the first time point.

2. The inkjet printing apparatus according to claim 1, wherein the heating element is provided in such a manner as to cover at least one side of the printing element array in a crossing direction which crosses the predetermined direction of the printing element array.

3. The inkjet printing apparatus according to claim 2, wherein the heating element is provided in such a manner as to surround the printing element array.

4. The inkjet printing apparatus according to claim 1, further comprising:

a first detection unit that detects a temperature of the substrate to obtain information indicating a temperature of ink near the printing elements.

5. The inkjet printing apparatus according to claim 4, wherein the first detection unit is arranged near one end portion of the printing element array in the predetermined direction.

6. The inkjet printing apparatus according to claim 1, further comprising:

a second detection unit for detecting an apparatus internal temperature near the printing head within the inkjet printing apparatus, wherein the heating control unit determines a difference between the first and second time points in accordance with the apparatus internal temperature detected by the second detection unit.

7. The inkjet printing apparatus according to claim 6, wherein the heating control unit controls the first heating and second heating in such a manner that a difference between the first and second time points in a case in which an apparatus internal temperature detected by the second detection unit is a first temperature is larger than a difference between the first and second time points in a case in which an apparatus internal temperature detected by the second detection unit is a second temperature which is higher than the first temperature.

8. The inkjet printing apparatus according to claim 1, wherein in a case in which the heating control unit has controlled the first heating and second heating in such a manner that the first heating is performed from the first time point to a third time point subsequent to the second time point and the second heating is performed from the second time point to the third time point, a temperature of ink near a printing element arranged in a first position in the predetermined direction of the printing element array is approximately the same as a temperature of ink near a printing element arranged in a second position different from the first position in the predetermined direction of the printing element array at the third time point.

9. The inkjet printing apparatus according to claim 8, wherein the first position is one end portion of the printing element array in the predetermined direction, and wherein the second position is a center portion of the printing element array in the predetermined direction.

10. An inkjet printing apparatus comprising:

a printing head including a substrate including at least a printing element array in which a plurality of printing elements for generating thermal energy used to eject ink from ejection ports are arranged in a predetermined direction and a heating element for heating ink near the printing elements, the heating element being provided near at least one end portion of the printing element array in the predetermined direction;

a first detection unit that detects a temperature of the substrate to obtain information indicating a temperature of ink near the printing elements;

a heating control unit that causes an execution of a first heating that heats ink near the printing elements by causing the heating element to generate a first amount of thermal energy per unit time to drive the printing element and an execution of a second heating that heats ink near the printing elements by causing the printing elements to generate a second amount of thermal energy per unit time larger than the first amount by driving the printing elements to an extent insufficient to cause ink to be ejected from the amount of temperature rise; and a printing control unit that performs control in such a manner that ink ejection from the printing head is started when a temperature of ink near the printing elements reaches a predetermined temperature as a result of the first and second heating caused by the heating control unit, wherein the heating control unit starts driving the heating element in a case in which the temperature detected by the first detection unit is a first temperature that is lower than the predetermined temperature, and starts driving the printing elements in a case in which the temperature detected by the first detection unit is higher than the first temperature and is a second temperature that is lower than the predetermined temperature.

11. An inkjet printing apparatus comprising:

a printing head including a substrate including at least a printing element array in which a plurality of printing elements for generating thermal energy used to eject ink from ejection ports are arranged in a predetermined direction and a heating element for heating ink near the printing elements, the heating element being provided near at least one end portion of the printing element array in the predetermined direction;

a heating control unit that causes an execution of a first heating that heats ink near the printing elements by causing the heating element to generate a first amount of thermal energy per unit time to drive the printing element and an execution of a second heating that heats ink near the printing elements by causing the printing elements to generate a second amount of thermal energy per unit time smaller than the first amount by driving the printing elements to an extent insufficient to cause ink to be ejected from the ejection ports; and a printing control unit that performs control in such a manner that ink ejection from the printing head is started when a temperature of ink near the printing elements reaches a predetermined temperature as a result of the first and second heating caused by the heating control unit, wherein the heating control unit starts driving the heating element at a first time point and starts driving the printing elements at a second time point prior to the first time point.

12. An inkjet printing apparatus comprising:

a printing head including a substrate including at least a printing element array in which a plurality of printing elements for generating thermal energy used to eject ink from ejection ports are arranged in a predetermined direction and a heating element for heating ink near the printing elements, the heating element being provided near at least one end portion of the printing element array in the predetermined direction;

a heating control unit that causes an execution of a first heating that heats ink near the printing elements indirectly through the substrate by causing the heating element to generate thermal energy to drive the printing element and an execution of a second heating that directly heats ink near the printing elements by causing the printing elements to generate thermal energy by driving the printing elements to an extent insufficient to cause ink to be ejected from the ejection ports; and a printing control unit that performs control in such a manner that ink ejection from the printing head is started when a temperature of ink near the printing elements reaches a predetermined temperature as a result of the first and second heating caused by the heating control unit, wherein the heating control unit starts driving the heating element at a first time point and starts driving the printing elements at a second time point subsequent to the first time point.

13. An inkjet printing method for printing an image using a printing head including a substrate including at least a printing element array in which a plurality of printing elements for generating thermal energy used to eject ink from ejection ports are arranged in a predetermined direction and a heating element for heating ink near the printing elements, the heating element being provided near at least one end portion of the printing element array in the predetermined direction; the method comprising:

a heating control process for causing an execution of a first heating that heats ink near the printing elements by causing the heating element to generate a first amount of thermal energy per unit time to drive the printing element and an execution of a second heating that heats ink near the printing elements by causing the printing elements to generate a second amount of thermal energy per unit time larger than the first amount by driving the printing elements to an extent insufficient to cause ink to be ejected from the ejection ports; and a printing control process for performing control in such a manner that ink ejection from the printing head is started when a temperature of ink near the printing elements reaches a predetermined temperature as a result of the first and second heating caused by the heating control process, wherein the heating control process causes starting driving the heating element at a first time point and starting driving the printing elements at a second time point subsequent to the first time point.

14. A non-transitory computer-readable storage medium storing a program that causes a computer to execute the inkjet printing method according to claim 13.

* * * * *